US007121476B2

(12) United States Patent
Buehler et al.

(10) Patent No.: US 7,121,476 B2
(45) Date of Patent: Oct. 17, 2006

(54) FUEL INJECTION DEVICE

(75) Inventors: Christoph Buehler, Gerlingen (DE); Juergen Frasch, Holzgerlingen (DE); Christoph Butscher, Leonberg (DE); Michael Scheurer, Gerlingen (DE); Stephan Wehr, Heihgenstadt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/266,228

(22) Filed: Nov. 4, 2005

(65) Prior Publication Data

US 2006/0097067 A1 May 11, 2006

(30) Foreign Application Priority Data

Nov. 5, 2004 (DE) ..... 10 2004 053 421

(51) Int. Cl.
*F02M 47/02* (2006.01)
*B05B 1/30* (2006.01)

(52) U.S. Cl. ..... 239/88; 239/89; 239/91; 239/92; 239/124; 239/533.2; 123/467; 123/446

(58) Field of Classification Search ..... 239/88, 239/585.1, 89, 90, 91, 92, 124, 126, 533.2; 123/467, 446
See application file for complete search history.

(56) References Cited

U.S. PATENT DOCUMENTS 6,328,017 B1 * 12/2001 Heinz et al. ..... 123/467
6,453,875 B1 * 9/2002 Mahr et al. ..... 123/446
6,629,647 B1 * 10/2003 Boecking ..... 239/88
6,644,281 B1 * 11/2003 Boehland ..... 123/467
6,659,086 B1 * 12/2003 Rodriguez-Amaya et al. ..... 123/467

* cited by examiner

*Primary Examiner*—Dinh Q. Nguyen
(74) *Attorney, Agent, or Firm*—Ronald E. Greigg

(57) ABSTRACT

A fuel injection device, which has: a nozzle needle, guided displaceably in a nozzle body, which as a function of its position opens or closes at least one injection opening, in which a control chamber, to which fuel can be delivered under pressure via an inlet throttle and from which fuel can be diverted, controlled by a control valve, via an outlet throttle, is provided at a piston face of the nozzle needle facing away from the injection opening, and in which in operation, the position of the nozzle needle is controlled by a pressure difference between the pressure in the control chamber and the pressure of the fuel at the end, toward the injection opening, of the nozzle needle, is characterized in that the nozzle needle is surrounded, over at least part of its length, during operation by fuel at high pressure, such that only in the regions of the nozzle needle near the injection opening and in the control chamber can a lower pressure, differing from the high fuel pressure, occur.

5 Claims, 3 Drawing Sheets

FUEL INJECTION DEVICE

CROSS-REFERENCE TO RELATED APPLICATIONS

This application is based on German Patent Application 10 2004 053 421.7 filed Nov. 5, 2004, upon which priority is claimed.

BACKGROUND OF THE INENTION

1. Field of the Invention

This invention relates to an improved fuel injection device for use in internal combustion engines.

2. Description of the Prior Art

A fuel injector device of the type with which this invention is concerned is known from German patent disclosure DE 199 10 971 A1, FIG. 6. In this known device, there is a chamber at leak fuel pressure in a region of the nozzle needle between the control chamber and the injection openings. In those times when no injection whatever is taking place, a leakage loss occurs into this chamber. This leakage does not serve the function of the injection device.

OBJECT AND SUMMARY OF THE INVENTION

Since energy consumption is associated with the leakage, it is an object of the invention to provide an improved fuel injection device in which the leakage is reduced compared to the prior art.

One advantage of the fuel injection device is that in the region of the nozzle needle, leakage occurs practically only at those times when the nozzle needle is opened for injection. Only when the needle is open does leakage occur in the direction of the control chamber along the control chamber sleeve, which is prestressed by a spring and laterally defines the control chamber. Conversely, there is no leakage or only slight leakage when the injection valve is closed. In this example, such leakage occurs along the guide diameter of the valve needle of a magnet valve.

Leakage that occurs, for instance because the entire injection device is constructed of disklike elements, which are stacked on one another and pressed together in their longitudinal direction, at the contacting surface of these elements is not taken into account here. This type of leakage cannot be prevented by the invention.

In one embodiment it is advantageous that compared to the already quite high pressure that a pressure reservoir (common rail) makes available, the pressure can be increased directly at the injection device. As a result, there is a unit comprising the pressure booster and the injection valve, which by the combination of the pressure course that the pressure booster makes available for feeding to the injection valve and the combination of controlling the nozzle needle by the control valve makes it possible to create special capabilities in controlling the fuel delivery to an internal combustion engine.

It is advantageous that because of the closeness of the control valve to the nozzle (nozzle needle), fast control times are possible, since there is no need for a large amount of fuel (control quantity) to be diverted out of the control valve. The construction is moreover simple and economical.

It is also advantageous that on being installed in an internal combustion engine, a connection that must be made separately by hand to a leak fuel line is not required by the device, since because of the recesses in the sleeve (in this example a nozzle turnbuckle sleeve), the leak fuel flows out of the device of the invention, in the installed state, into a conduit in the engine housing or a cylinder head cap, which is provided for carrying away leak fuel and which in the motor vehicle that is ready for operation communicates with a return line for leak fuel to the fuel tank. The disposition of one or more recesses in the sleeve can be selected by the manufacturer such that the device of the invention can be used for replacing other injection devices, either for repair purposes or even, without modification, on the engine for re-fitting of that engine.

BRIEF DESCRIPTION OF THE DRAWINGS

The invention will be better understood and further objects and advantages thereof will become more apparent from the ensuing detailed description of preferred embodiments, taken in conjunction with the drawings, in which.

DESCRIPTION OF THE PREFERRED EMBODIMENTS

Figure 1:
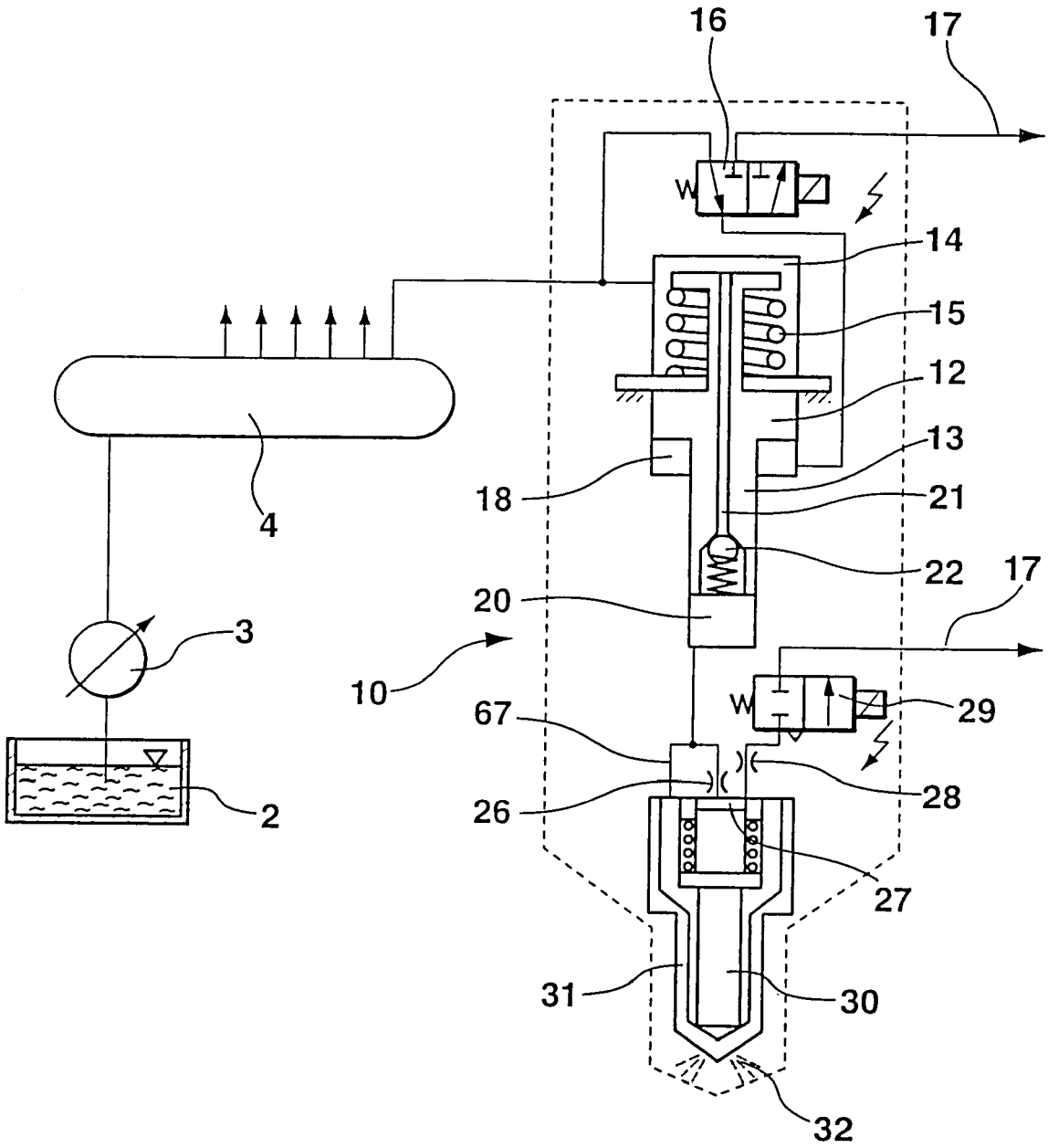
FIG. 1 is a schematic illustration of a fuel injection device with a stroke-controlled nozzle needle, the device being supplied with fuel at high pressure from a pressure reservoir (common rail), and the pressure of the fuel supplied to the injection nozzle being further increased by a pressure booster.

In FIG. 1, from a fuel tank 2 by means of a pump 3, a high-pressure reservoir 4 (common rail) is filled with fuel (in this example, diesel fuel) at high pressure. The pressure is typically 1000 bar. The common rail 4 is provided for supplying six fuel injection devices 10, of which only one is shown. In other embodiments of the invention, more or fewer such devices 10 may instead be present. In its upper part, the fuel injection device 10 has a hydraulic pressure booster, which has a first piston 12 and a second piston 13, rigidly connected to the first, with a smaller piston face than that of the piston 12. A chamber 14 above the first piston 23 communicates with the common rail 4. The first piston 12 is prestressed by a compression spring 15 into its upper position, shown in FIG. 1. A chamber 18 below the first piston 12 communicates via what in this example is an electrically actuated valve 15 (3/2-way valve) with either the chamber 14 (as shown in FIG. 1), or a leak fuel line 17, depending on the switching position of the valve. The underside of the first piston is smaller than the top side. The difference between the two surface areas is equal to the cross section of the second piston 13. In operation, the pressure of the common rail 4 prevails in the chamber 14 at all times.

In operation, for the execution of a downward-oriented motion (compression stroke) of the pistons 12 and 13, the chamber 18 communicates with the leak fuel line 17 via the valve 16. The piston 13 in this process increases the pressure of the fuel in a compression chamber 20 beyond the pressure in the common rail 4 in the ratio of (upper surface area of the piston 12)/(cross section of the piston 13). The aforementioned elevated pressure may in this example be 2000 bar. The outlet of the compression chamber 20 communicates with a stroke-controlled injection nozzle. After the switchover of the valve 16, the pistons 12, 13 are returned to the position shown in FIG. 1, being moved back upward only by the compression spring 15. In the process, fuel flows from the chamber 14 into the compression chamber 20 through a central conduit 21 penetrating the pistons, whereupon a check valve 22 in the piston 13 opens. In the compression stroke, the check valve is closed. Then the pistons 12, 13 are moved upward, or when they are not in motion, fuel at the pressure of the common rail 4 can reach the injection nozzle via the check valve. The injection nozzle can therefore be supplied with fuel at a different pressure, depending on operational requirements.

Fuel from the compression chamber 20 is delivered to a stroke-controlled injection nozzle, to which a control valve 29 belongs. Via an inlet throttle 26, the fuel reaches a control chamber 27 and increases the pressure in it. Via an outlet throttle 28, as a function of the position of the control valve 29, the control chamber 27 is relieved, or kept at high pressure, as shown in FIG. 1 (blocked control valve). A nozzle needle 30 (or valve needle) of the injection device is displaceable in a nozzle body 31 and is subjected in the region of a pressure step (that is, a piston face acting in the opening direction) to the pressure in the opening direction of the fuel that is carried via a line 67 to the lower end of the nozzle needle 30. When the pressure in the control chamber 27 is low enough, the nozzle needle 30 opens. When the pressure in the control chamber 27 thereupon rises again far enough, the nozzle needle closes.

Figure 2:
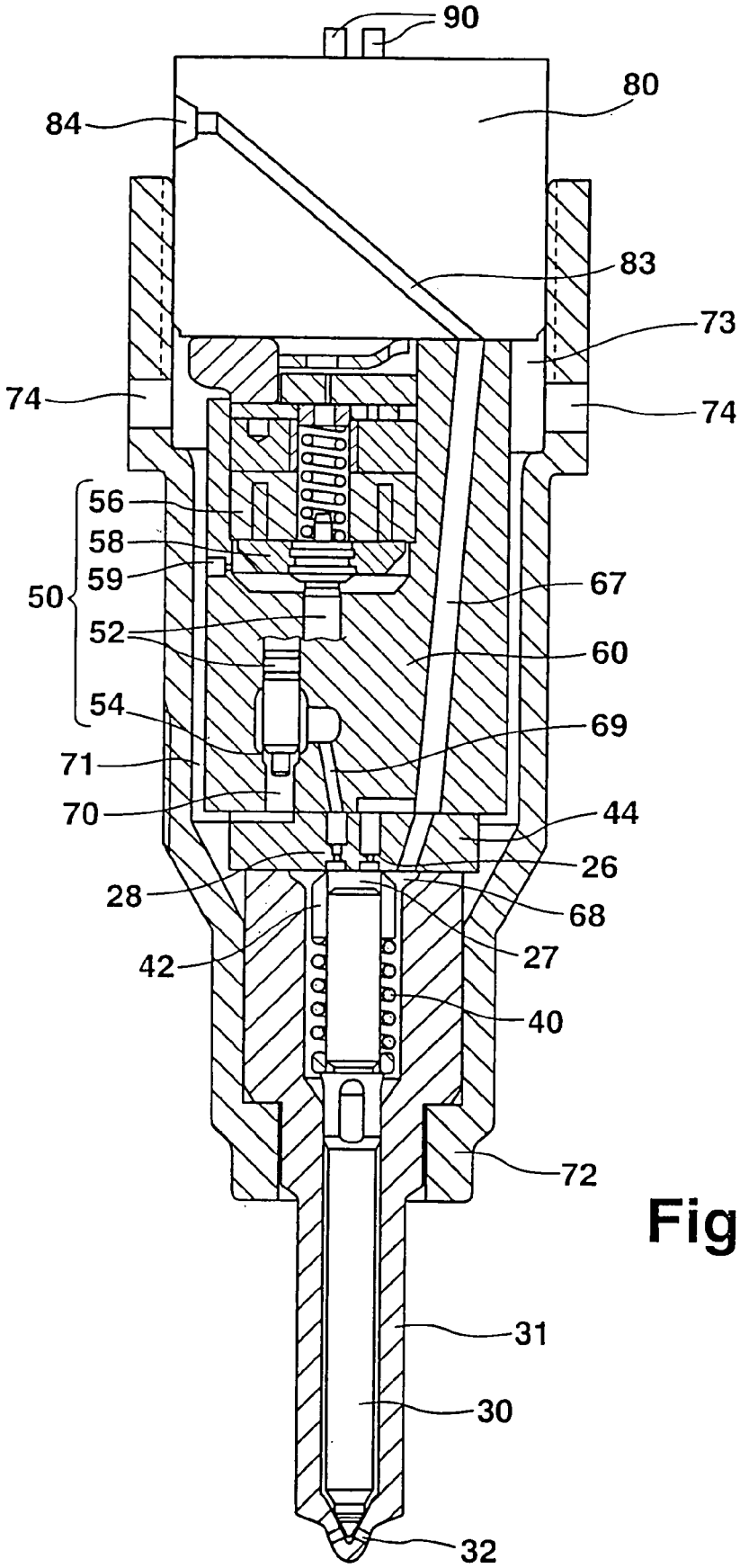
FIG. 2 is a longitudinal section, partly fragmentary, through a first exemplary embodiment of a fuel injection device of the invention, which represents a realization according to the invention of a device of FIG. 1, but without a pressure booster.

The elements already identified by reference numerals in FIG. 1 are identified by the same reference numerals in FIG. 2. The nozzle needle 30 (or valve needle) of the injection device, in the closed state shown, rests with a sealing edge, not identified by reference numeral, on a valve seat of the nozzle body 31 surrounding the nozzle needle. The fuel that with the nozzle needle closed has advanced as far as the valve seat exerts a force acting in the opening direction on the pressure step located in the region of the end of the nozzle needle. In the end region of the nozzle needle 30, facing away from the injection openings 32, the nozzle needle is surrounded by a compression spring 40, which presses a control valve sleeve 42 against the face, toward the injection openings 32, of a throttle plate 44, so that the lateral boundary of the control chamber 27 is thus formed. The inlet throttle 26 and the outlet throttle 28 are provided in the throttle plate 44. The control valve 50 that controls the pressure in the control chamber 27 has a movable valve part 52, which in the blocking position rests sealingly on a valve seat 54. In the blocked state, the control valve 50 blocks the flow of fuel out of the control chamber 27 through the outlet throttle 28. An electromagnet 56, which is supplied with switching power from outside via electrical terminals, actuates a magnet armature 58. This magnet armature is shown in FIG. 2 in the attracted state; that is, the movable valve part 52 has lifted from its valve seat, and the control chamber is relieved. The chamber that receives the magnet armature 58 communicates via a conduit 59, and a throttle that keeps pressure fluctuations away from the aforementioned chamber, with the outside of a control valve housing 60 that receives the control valve. This housing rests on the top side of the throttle plate 44. The movable valve part 52 of the control valve is guided displaceably with good sealing in a bore of the control valve housing so that along this bore, as little leakage as possible toward the magnet armature 58 occurs when the control valve is closed.

The fuel is carried via a conduit 67 through the throttle plate 44 into the chamber 68 surrounding the nozzle needle 30 and from there reaches the sealing edge of the nozzle needle 30. A line branches off to the inlet throttle 26 from the conduit 67.

With the control valve 50 open, the fuel flowing out of the control chamber 27 flows via a conduit 59 to the control valve 50 and from there via a conduit into the chamber 71, which surrounds both the lower end region, in terms of FIG. 2, of the control valve housing 60 and the throttle plate 44 as well as the control valve housing 60 itself almost all the way to the top and which is formed between these parts just mentioned and a sleeve 72 (in this example a nozzle turnbuckle sleeve) that holds the entire arrangement together.

Since the outlet throttle 28 and the conduit 69 are not located in the sectional plane of FIG. 2, they have been shifted into the plane of the drawing for the sake of clarity, and the movable valve part 52 is shown in a fragmentary view.

The chamber 71 changes over at the upper end into a thicker chamber 73. The sleeve 72 is screwed together with a basic body 80. In the sleeve 72, there are recesses 74 embodied as bores. The recesses 74, which point radially outward, for a connection for leak fuel and for control quantities to be carried away, and in the installed state, at least one recess 74 communicates with a conduit, provided inside a cylinder head cap of an internal combustion engine, for carrying away leak fuel. The recesses 74 thus form connections for the leak fuel to be removed from the chamber 71. Parts of the injection device are thus constantly surrounded by fuel at leak fuel pressure; that is, the sleeve (the nozzle turnbuckle sleeve) is flooded. The upper end of the conduit 67 communicates with a conduit 83 in the basic body 80. The conduit 83 leads to a high-pressure connection 84, somewhat above the end of the sleeve 72. The high-pressure connection 84 has a frustoconical indentation, into which a connection piece of a connection line is inserted in sealed fashion and secured by connecting means. The high-pressure connection can be made to communicate with an arbitrary suitable source of fuel at sufficiently high pressure. There are also electrical terminals 90 for the electromagnet 56 on the basic body 80.

From leakage, which it might not be possible to preclude entirely, at the points where the various components of the injection device are pressed together by a pressure of the sleeve 72 exerted in the longitudinal direction, unwanted leakage occurs in the arrangement shown in FIG. 2 whenever the control valve 50 is open and thus fuel is flowing out of the control chamber 27, and as a result, the pressure in the control chamber 27 is less than the pressure in the chamber in which the spring 40 and the control chamber sleeve 42 are located. Specifically, at those times when the control valve 50 is closed (blocked), the nozzle needle 30 is surrounded over practically its entire length by fuel at high pressure, which is how the fuel is delivered to the conduit 67. The nozzle needle 30 is not in contact (except for the injection openings) with a region that is at leak fuel pressure. With the control valve 50 blocked, a slight leakage occurs along the movable valve part 52, toward its driving side, which in this example is toward the magnet armature 58.

With the arrangement of FIG. 2, the overall result obtained is simple guidance of the lines that are exposed to a high fuel pressure. High pressures are therefore possible.

Figure 3:
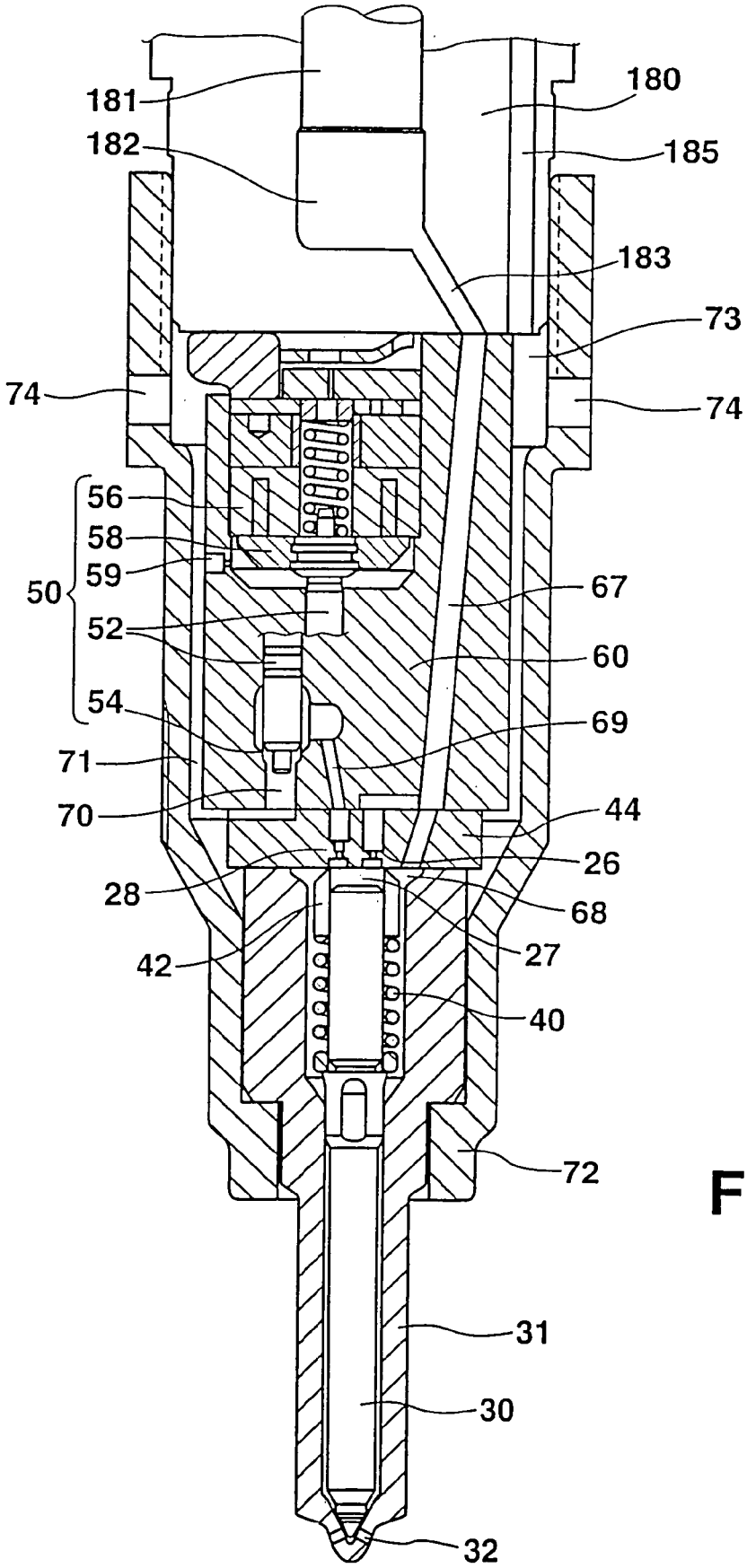
FIG. 3 shows a second exemplary embodiment of the invention in longitudinal section, with a built-in pressure booster.

The further embodiment of the invention shown in FIG. 3 differs from that of FIG. 2 in the replacement of the basic body 80 by a different part 180 with an integral pressure booster. Of the pressure booster, what can be seen in FIG. 3 are a compression piston 181 and a compression chamber 182. The chamber 182 furnishes a pressure from the pressure booster that is higher than the common rail pressure, and is in fluidic communication with the upper end of the conduit 67, via a conduit 183 provided in the part 180. The high-pressure connection for communication with a common rail 4 is not visible and is located farther away from the control valve 50 than in FIG. 2 in the upper region, also not visible, of part 180. Here as well, there are electrical terminals for the electromagnet of the control valve 50.

In the arrangement of FIG. 3, the still further advantage is attained that because of the built-in pressure booster that is integrated with the entire injection device, a novel and highly compact construction is attained, and as a result, the finished injection device is more easily installed in a motor vehicle as well.

The devices of the invention have less wear in comparison to the prior art, because the nozzle needle 30 is shorter than in known devices, and less friction therefore occurs.

Because of the chamber 71 that surrounds the sleeve on its inside over part of its length, and that serves to divert leakage, including control quantities, it is readily possible, depending on the construction of internal combustion engines in which the injection device is installed, to make the recesses 74 at the point that suits the aforementioned engine construction, without having to make any modifications whatever to the injection device.

The pressure booster in FIG. 3 is constructed in accordance with the principle of FIG. 1.

The exemplary embodiment of FIG. 3 is modified, in another example according to the invention, by providing that instead of the pressure booster, a different device that raises the pressure communicates with the sleeve 72. In a preferred example, this is a high-pressure pump driven by the engine.

The foregoing relates to preferred exemplary embodiments of the invention, it being understood that other variants and embodiments thereof are possible within the spirit and scope of the invention, the latter being defined by the appended claims.

We claim:

1. In a fuel injection device, which has:

a nozzle needle, guided displaceably in a nozzle body, which as a function of its position opens or closes at least one injection opening, in which a control chamber, to which fuel can be delivered under pressure via an inlet throttle and from which fuel can be diverted, controlled by a control valve, via an outlet throttle, is provided at a piston face of the nozzle needle facing away from the injection opening, and in which in operation, the position of the nozzle needle is controlled by a pressure difference between the pressure in the control chamber and the pressure of the fuel at the end, toward the injection opening, of the nozzle needle, the improvement wherein, during operation, the nozzle needle is surrounded by fuel at high pressure along its entire length, except for the end of the nozzle needle at the at least one injection opening and the piston face of the nozzle needle, such that only in the regions of the nozzle needle near the injection opening and at the piston face which is within the control chamber can a lower pressure, differing from the high fuel pressure, occur.

2. The device in accordance with claim 1, further comprising a pressure booster for the fuel, the pressure booster preferably being built into the fuel injection device or mounted on it.

3. The device in accordance with claim 1, wherein the control valve is located in the immediate vicinity of the control chamber.

4. The device in accordance with claim 2, wherein the control valve is located in the immediate vicinity of the control chamber.

5. In a fuel injection device, which has:

a nozzle needle, guided displaceably in a nozzle body, which as a function of its position opens or closes at least one injection opening, in which a control chamber, to which fuel can be delivered under pressure via an inlet throttle and from which fuel can be diverted, controlled by a control valve, via an outlet throttle, is provided at a piston face of the nozzle needle facing away from the injection opening, and in which in operation, the position of the nozzle needle is controlled by a pressure difference between the pressure in the control chamber and the pressure of the fuel at the end, toward the injection opening, of the nozzle needle, the improvement wherein the nozzle needle is surrounded, over at least part of its length, during operation by fuel at high pressure, such that only in the regions of the nozzle needle near the injection opening and in the control chamber can a lower pressure, differing from the high fuel pressure, occur, further comprising a sleeve, preferably a nozzle turnbuckle sleeve, which connects parts of the injection device to a basic body of the injection device, extending at least in part at a distance from the parts of the injection device that are surrounded by it, such that a chamber extending in the longitudinal direction of the injection device is formed, which chamber is bounded on the outside by the sleeve an outflow conduit of the control valve discharging into the chamber; and a recess penetrating the wall of the sleeve, the recess being suitable upon being built into an engine of being put into communication with a conduit in the engine for leak fuel.

* * * * *